US009575435B2

(12) United States Patent
Denton et al.

(10) Patent No.: US 9,575,435 B2
(45) Date of Patent: Feb. 21, 2017

(54) MAGNETIC ROLL FOR A DUAL COMPONENT DEVELOPMENT ELECTROPHOTOGRAPHIC IMAGE FORMING DEVICE

(71) Applicant: Lexmark International, Inc., Lexington, KY (US)

(72) Inventors: Gary Allen Denton, Lexington, KY (US); Katherine Marie Gilliam, Lexington, KY (US); Elliott Vincent Jernigan, Lexington, KY (US); Courtney Harrison Soale, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/556,291

(22) Filed: Dec. 1, 2014

(65) Prior Publication Data

US 2016/0154343 A1 Jun. 2, 2016

(51) Int. Cl.
*G03G 15/09* (2006.01)
*G03G 15/08* (2006.01)

(52) U.S. Cl.
CPC ..... *G03G 15/0928* (2013.01); *G03G 15/0818* (2013.01)

(58) Field of Classification Search
CPC combination set(s) only.
See application file for complete search history.

(56) References Cited

U.S. PATENT DOCUMENTS 4,389,113 A * 6/1983 Matsumoto ..... G03G 15/0126 399/231
6,327,452 B1 12/2001 Jaskowiak et al.
2004/0028428 A1* 2/2004 Sugihara ..... G03G 9/1134 399/267
2008/0080905 A1* 4/2008 Hirota ..... G03G 15/0818 399/270

(Continued)

FOREIGN PATENT DOCUMENTS

EP 2525262 A1 11/2012
JP 2003-208027 A 7/2003

OTHER PUBLICATIONS

Extended European Search Report dated Apr. 12, 2016 for European Patent Application No. 15196551.4.

(Continued)

*Primary Examiner* — Clayton E Laballe
*Assistant Examiner* — Jas Sanghera
(74) *Attorney, Agent, or Firm* — Justin M. Tromp

(57) ABSTRACT

An outer sleeve of a magnetic roll for a dual component development electrophotographic image forming device according to one example embodiment includes a series of grooves in an outer surface of the outer sleeve. The grooves extend along an axial length of the sleeve and are spaced circumferentially from each other around the outer sleeve. The outer sleeve has a diameter of between 15 mm and 30 mm, inclusive. The grooves are present on the outer surface of the outer sleeve at a groove density of at least 1.91 grooves/mm of the circumference of the outer surface of the outer sleeve and a total indicated runout of the outer sleeve is 0.05 mm or less.

25 Claims, 6 Drawing Sheets

(56) References Cited

U.S. PATENT DOCUMENTS

| | | | | |
|---|---|---|---|---|
| 2011/0150526 | A1* | 6/2011 | Sasaki | G03G 21/1821 399/111 |
| 2012/0195647 | A1 | 8/2012 | Nose et al. | |
| 2014/0023408 | A1 | 1/2014 | Kato et al. | |

OTHER PUBLICATIONS

English Translation of Japanese Patent Application Publication No. 2003-208027A dated Jul. 25, 2003 (Ricoh Co. Ltd.).

* cited by examiner

MAGNETIC ROLL FOR A DUAL COMPONENT DEVELOPMENT ELECTROPHOTOGRAPHIC IMAGE FORMING DEVICE

CROSS REFERENCES TO RELATED APPLICATIONS

None.

BACKGROUND

1. Field of the Disclosure

The present disclosure relates generally to image forming devices and more particularly to a magnetic roll for a dual component development electrophotographic image forming device.

2. Description of the Related Art

Dual component development electrophotographic image forming devices include one or more reservoirs that store a mixture of toner and magnetic carrier beads (the "developer mix"). Toner is electrostatically attracted to the carrier beads as a result of triboelectric interaction between the toner and the carrier beads. A magnetic roll includes a stationary core having one or more permanent magnets and a sleeve that rotates around the core. The magnetic roll attracts the carrier beads in the reservoir having toner thereon to the outer surface of the sleeve through the use of magnetic fields from the core. A photoconductive drum in close proximity to the sleeve of the magnetic roll is charged by a charge roll to a predetermined voltage and a laser selectively discharges areas on the surface of the photoconductive drum to form a latent image on the surface of the photoconductive drum. The sleeve is electrically biased to facilitate the transfer of toner from the developer mix on the outer surface of the sleeve to the discharged areas on the surface of the photoconductive drum forming a toner image on the surface of the photoconductive drum. The photoconductive drum then transfers the toner image, directly or indirectly, to a media sheet forming a printed image on the media sheet.

As the developer mix on the outer surface of the sleeve approaches the photoconductive drum by rotation of the sleeve, the developer mix is trimmed to a desired mass on the magnetic roll by a trim bar. A gap between the trim bar and the outer surface of the sleeve (the "trim bar gap") dictates how much developer mix is allowed to pass on the outer surface of the sleeve from the reservoir toward the photoconductive drum. The developer mix tends to accumulate and for a shear zone in the reservoir upstream from the trim bar gap. Friction between the outer surface of the sleeve and the developer mix is required to move the developer mix through the shear zone and the trim bar gap to the photoconductive drum.

The magnetic roll sleeve often includes a textured or roughened outer surface in order to provide the desired amount of friction between the outer surface of the sleeve and the developer mix. For example, the outer surfaces of some magnetic roll sleeves are grit blasted. Other magnetic roll sleeves include a series of grooves that extend axially along the length of the sleeve and are equally spaced circumferentially from each other about the outer surface of the sleeve. Some grooved magnetic roll sleeves include a groove density of about 1.27 grooves/mm of the circumference of the outer surface of the sleeve (e.g., 100 grooves on a sleeve having an outer diameter of 25 mm or 80 grooves on a sleeve having an outer diameter of 20 mm). Some larger magnetic roll sleeves, on the order of 62.5 mm in outer diameter, include a knurled outer surface having a sinusoidal, washboard-like knurl pattern that is present on the outer surface of the sleeve at a density of between about 1 and about 1.25 indentations/mm of the circumference of the outer surface of the sleeve. These knurled magnetic roll sleeves have a relatively large circumferential spacing between indentations of between about 0.8 mm and about 1 mm (measured from the center of the trough of one indentation to the center of the trough of the neighboring indentation). These knurled magnetic roll sleeves also have a high (e.g., much greater than 0.1 mm) total indicated runout, a measure of how concentric the sleeve is along its axial length.

Buildup of toner on the outer surface of the sleeve over the life of the magnetic roll tends to increase the amount of friction between the outer surface of the sleeve and the developer mix thereby allowing more developer mix to pass through the trim bar gap and increasing the mass of developer mix on the magnetic roll. Excessive mass of developer mix on the magnetic roll may lead to high rates of carrier bead and toner loss thereby decreasing the life of a replaceable unit holding the reservoir(s) and increasing the operating cost of the image forming device for the user. Accordingly, a magnetic roll sleeve that provides sufficient and consistent friction between the outer surface of the sleeve and a developer mix over the life of the magnetic roll is desired.

SUMMARY

An outer sleeve of a magnetic roll for a dual component development electrophotographic image forming device according to one example embodiment includes a series of grooves in an outer surface of the outer sleeve. The grooves extend along an axial length of the sleeve and are spaced circumferentially from each other around the outer sleeve. The outer sleeve has a diameter of between 1.5 mm and 30 mm, inclusive. The grooves are present on the outer surface of the outer sleeve at a groove density of at least 1.91 grooves/mm of the circumference of the outer surface of the outer sleeve and a total indicated runout of the outer sleeve is 0.05 mm or less.

An outer sleeve of a magnetic roll for a dual component development electrophotographic image forming device according to another example embodiment includes between 150 and 250 grooves, inclusive, in an outer surface of the outer sleeve. The grooves extend along an axial length of the outer sleeve and are spaced circumferentially from each other around the outer sleeve. The outer sleeve has a diameter of between 24 mm and 26 mm, inclusive.

A magnetic roll for a dual component development electrophotographic image forming device according to one example embodiment includes a stationary core having at least one permanent magnet. A sleeve positioned around the core is rotatable relative to the core about an axis of rotation. There are a series of grooves in an outer surface of the sleeve. The grooves extend along the axial length of the sleeve and are spaced circumferentially from each other around the sleeve. The sleeve has a diameter of between 15 mm and 30 mm, inclusive. The grooves are present on the outer surface of the sleeve at a groove density of at least 1.91 grooves/mm of the circumference of the outer surface of the sleeve and a total indicated runout of the sleeve is 0.05 mm or less.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
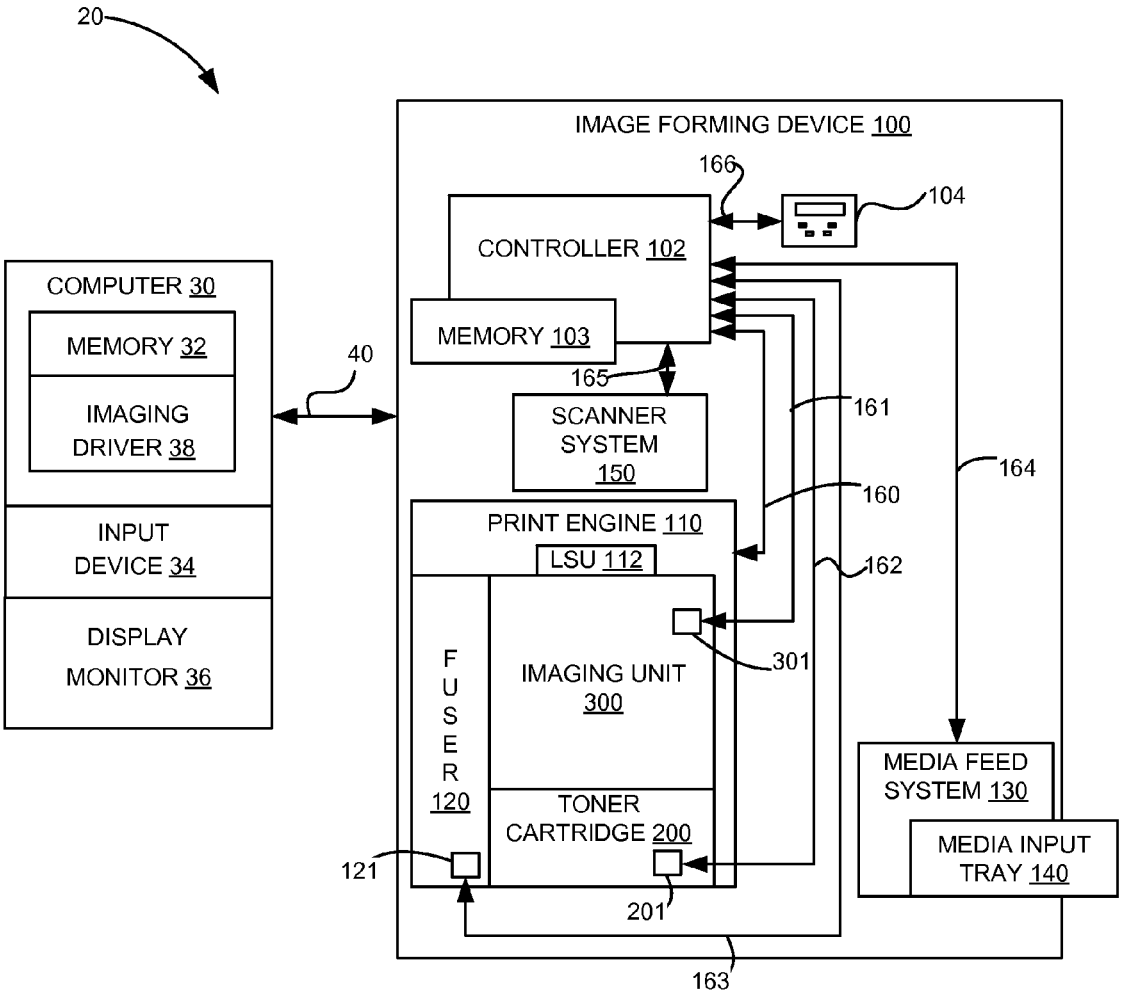
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof, such as, for example, random access memory (RAM), read only memory (ROM), flash memory and/or non-volatile RAM (NVRAM). Alternatively, memory 103 may be in the from of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory, such as RAM, ROM, and/or NVRAM, and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer, such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
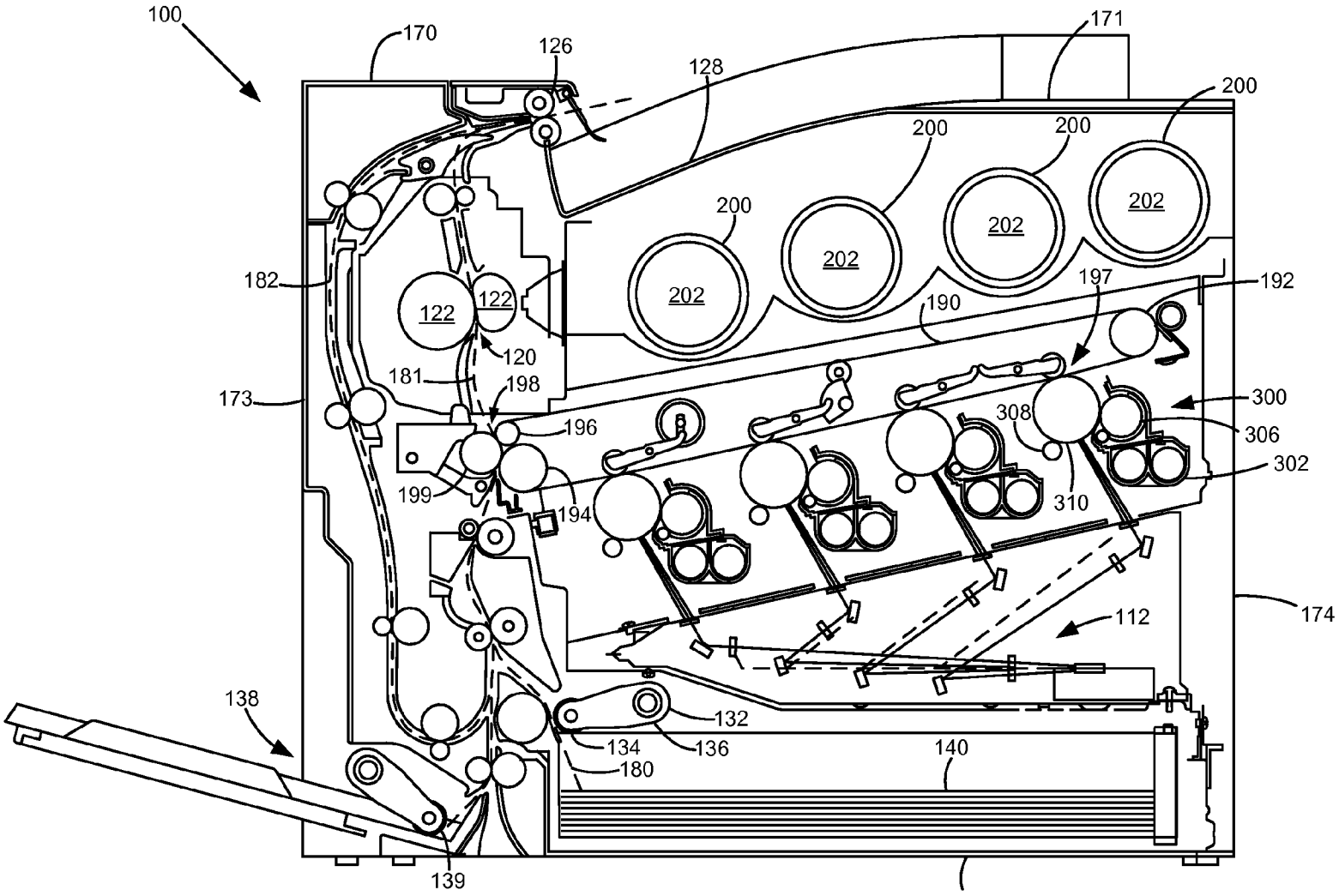
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which may also be removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

Image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Each imaging unit 300 also includes a charge roll 308 and a photoconductive (PC) drum 310 and a cleaner blade or roll (not shown) that collectively form a PC unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Magnetic roll 306 attracts the carrier beads in reservoir 302 having toner thereon to magnetic roll 306 through the use of magnetic fields and transports the toner to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a color image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component, such as a chute, duct or hopper, that connects the toner cartridge 200 with its corresponding imaging unit 300.

Imaging unit(s) 300 may be replaceable in any combination desired. For example, in one embodiment, the developer unit and PC unit are provided in separate replaceable units from each other. In another embodiment, the developer unit and PC unit are provided in a common replaceable unit. In another embodiment, toner reservoir 202 is provided with the developer unit instead of in a separate toner cartridge 200. For a color image forming device 100, the developer unit and PC unit of each color toner may be separately replaceable or the developer unit and/or the PC unit of all colors (or a subset of all colors) may be replaceable collectively as desired.

Figure 3:
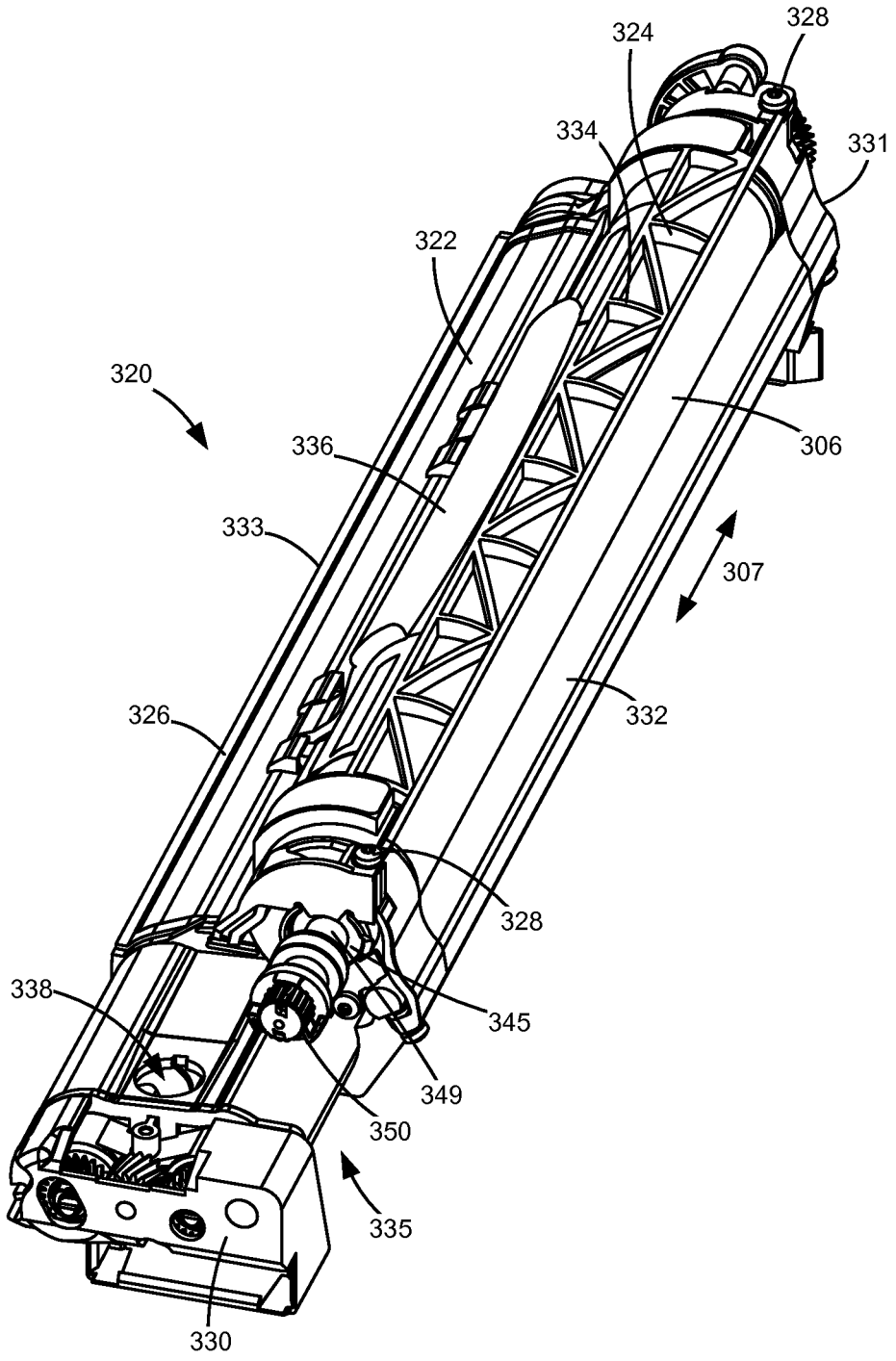
FIG. 3 is a perspective view of a developer unit according to one example embodiment.
Figure 4:
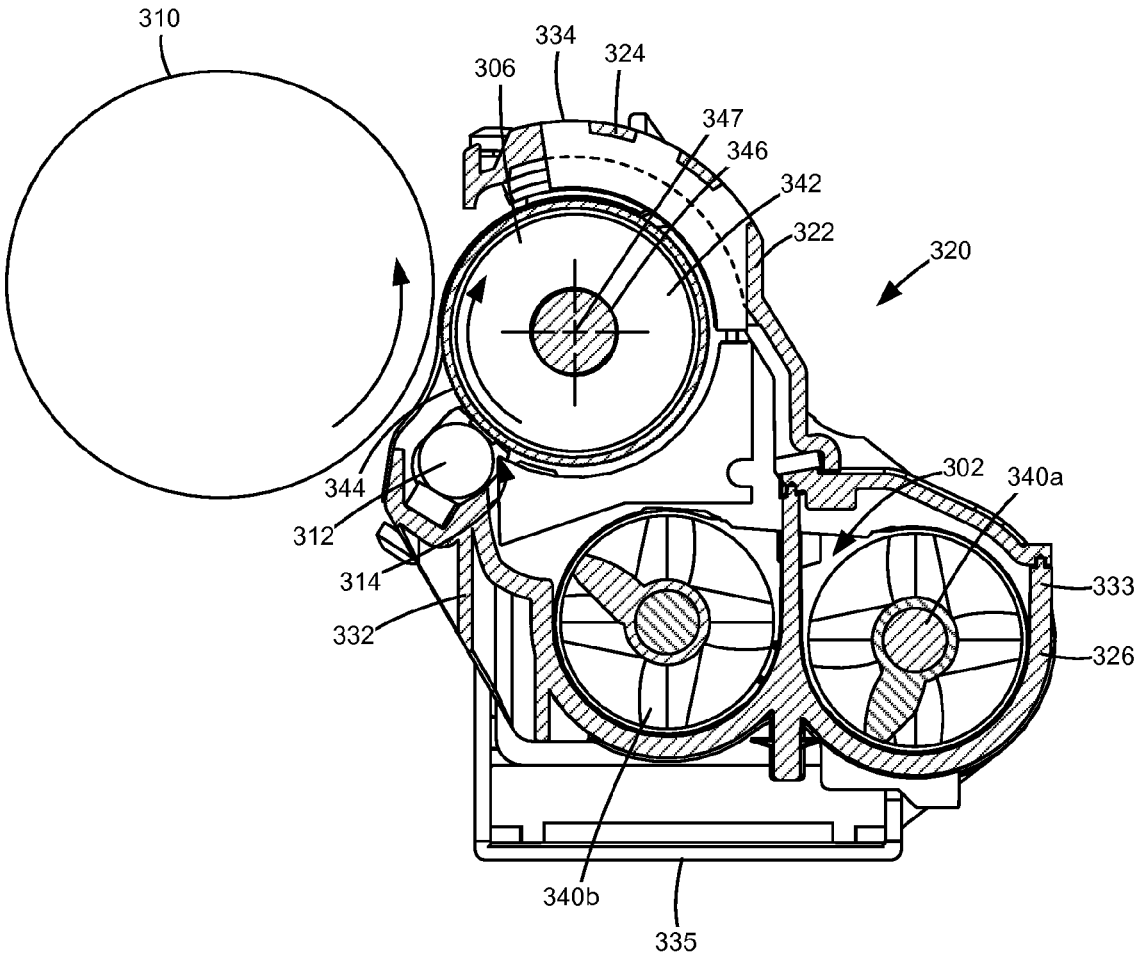
FIG. 4 is a cross-sectional view of the developer unit shown in FIG. 3.

FIGS. 3 and 4 show a developer unit 320 according to one example embodiment. Developer unit 320 includes a housing 322 having reservoir 302 therein. In the example embodiment illustrated, housing 322 includes a lid 324 mounted on a base 326. Lid 324 may be attached to base 326 by any suitable construction including, for example, by fasteners (e.g., screws 328), adhesive and/or welding. Housing 322 extends generally along an axial direction 307 of magnetic roll 306 from a first side 330 of housing 322 to a second side 331 of housing 322. Side 330 leads during insertion of developer unit 320 into image forming device 100. A portion of magnetic roll 306 is exposed at a front 332 of housing 322. A handle 326 is optionally positioned on a rear 333 of housing 322 to assist with separating developer unit 320 from the corresponding PC unit. Housing 322 also includes a top 334 and a bottom 335.

Reservoir 302 holds the mixture of toner and magnetic carrier beads (the "developer mix"). Developer unit 320 includes an inlet port 338 in fluid communication with reservoir 302 and positioned to receive toner from toner cartridge 200 to replenish reservoir 302 when the toner concentration in reservoir 302 relative to the amount of carrier beads remaining in reservoir 302 gets too low as toner is consumed from reservoir 302 by the printing process. In the example embodiment illustrated, inlet port 338 is positioned on top 334 of housing 322 near side 330; however, inlet port 338 may be positioned at any suitable location on housing 322.

Reservoir 302 includes one or more agitators to stir and move the developer mix. For example, in the embodiment illustrated, reservoir 302 includes a pair of augers 340*a*, 340*b*. Augers 340*a*, 340*b* are arranged to move the developer mix in opposite directions along the axial length of magnetic roll 306. For example, auger 340*a* is positioned to incorporate toner from inlet port 338 and to move the developer mix away from side 330 and toward side 331. Auger 340*b* is positioned to move the developer mix away from side 331, in proximity to the bottom of magnetic roll 306 and toward side 330. This arrangement of augers 340*a*, 340*b* is sometimes informally referred to as a racetrack arrangement because of the circular path the developer mix in reservoir 302 takes when augers 340*a*, 340*b* rotate.

With reference to FIG. 4, magnetic roll 306 includes a core 342 that includes one or more permanent magnets and that does not rotate relative to housing 322. A cylindrical sleeve 344 encircles core 342 and extends along the axial length of magnetic roll 306. Sleeve 344 has an outer diameter of between 15 mm and 30 mm, such as, for example, between 20 mm and 30 mm, between 20 m and 25 m and between 24 mm and 26 mm. A shaft 346 passes through the center of core 342 and defines an axis of rotation 347 of magnetic roll 306. Shaft 346 is fixed, i.e., shaft 346 does not rotate with sleeve 344 relative to housing 322, and controls the position of core 342 relative to sleeve 344. With reference back to FIG. 3, a rotatable end cap 345 is positioned at one axial end of magnetic roll 306, referred to as the drive side of magnetic roll 306. End cap 345 is coupled to sleeve 344 such that rotation of end cap 345 causes sleeve 344 to rotate around core 342. Sleeve 344 rotates in a clockwise direction as viewed in FIG. 4 to transfer toner from reservoir 302 to PC drum 310. A drive coupler 350 is operatively connected to end cap 345 either directly, such as on an end of a shaft 349 that extends axially outward from end cap 345 as shown in the example embodiment illustrated, or indirectly. Drive coupler 350 is positioned to receive rotational force from a corresponding drive coupler in image forming device 100 when developer unit 320 is installed in image forming device 100. Any suitable drive coupler 350 may be used as desired, such as a toothed gear or a drive coupler that receives rotational force at its axial end. In one embodiment, augers 340*a*, 340*b* are operatively connected to drive coupler 350 by one or more intermediate gears not shown). Alternatively, augers 340*a*, 340*b* may be driven independently of drive coupler 350 and sleeve 344 by a second drive coupler positioned to receive rotational force from a corresponding drive coupler in image forming device 100 when developer unit 320 is installed in image forming device 100.

Figure 5:
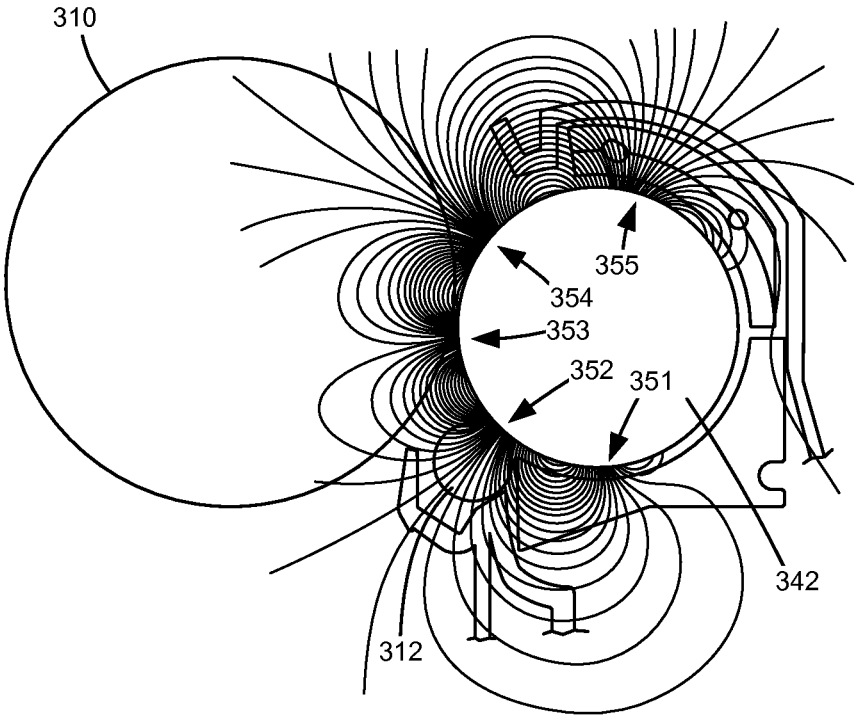
FIG. 5 is a schematic diagram of the developer unit of FIGS. 3 and 4 showing the magnetic field lines of a magnetic roll according to one example embodiment.

With reference to FIGS. 4 and 5, the permanent magnet(s) of core 342 include a series of circumferentially spaced, alternating (south v. north) magnetic poles that facilitate the transfer of toner to PC drum 310 as sleeve 344 rotates. FIG. 5 shows the magnetic field lines generated by the magnetic poles of core 342 according to one example embodiment. Core 342 includes a pickup pole 351 positioned near the bottom of core 342 (near the 6 o'clock position of core 342 as viewed in FIG. 5). Pickup pole 351 magnetically attracts developer mix in reservoir 302 to the outer surface of sleeve 344. The magnetic attraction from core 342 causes the developer mix to form cone or bristle-like chains that extend from the outer surface of sleeve 344 along the magnetic field lines.

After the developer mix is picked up at pickup pole 351, as sleeve 344 rotates, the developer mix on sleeve 344 advances toward a trim bar 312. Trim bar 312 is positioned in close proximity to the outer surface of sleeve 344. Trim bar 312 trims the chains of developer mix as they pass to a predetermined average height defined by a trim bar gap 314 formed between trim bar 312 and the outer surface of sleeve 344 in order to control the mass of developer mix on the outer surface of sleeve 344. Trim bar gap 314 dictates how much developer mix is allowed to pass on the outer surface of sleeve 344 from reservoir 302 toward PC drum 310. Trim bar 312 may be magnetic or non-magnetic and may take a variety of different shapes including having a flat or rounded trimming surface. Core 342 includes a trim pole 352 positioned at trim bar 312 to stand the chains of developer mix up on sleeve 344 in a generally radial orientation for trimming by trim bar 312. As shown in FIG. 5, between pickup pole 351 and trim pole 352, the chains of developer mix on sleeve 344 have a primarily tangential (as opposed to radial) orientation relative to the outer surface of sleeve 344 according to the magnetic field lines between pickup pole 351 and trim pole 352.

As sleeve 344 rotates further, the developer mix on sleeve 344 passes in close proximity to the outer surface of PC drum 310. As discussed above, electrostatic forces from the latent image formed on PC drum 310 by the laser beam from LSU 112 strip the toner from the carrier beads to form a toned image on the surface of PC drum 310. Core 342 includes a developer pole 353 positioned at the point where the outer surface of sleeve 344 passes in close proximity to the outer surface of PC drum 310 to once again stand the chains of developer mix up on sleeve 344 in a generally radial orientation to promote the transfer of toner from sleeve 344 to PC drum 310. The developer mix is less dense and less coarse when the chains of developer mix are stood up in a generally radial orientation than it is when the chains are more tangential. As a result, less wear occurs on the surface of PC drum 310 from contact between PC drum 310 and the chains of developer mix when the chains of developer mix on sleeve 344 are in a generally radial orientation.

As sleeve 344 continues to rotate, the remaining developer mix on sleeve 344, including the toner not transferred to PC drum 310 and the carrier beads, is carried by magnetic roll 306 past PC drum 310 and back toward reservoir 302. Core 342 includes a transport pole 354 positioned past the point where the outer surface of sleeve 344 passes in close proximity to the outer surface of PC drum 310. Transport pole 354 magnetically attracts the remaining developer mix to sleeve 344 to prevent the remaining developer mix from migrating to PC drum 310 or otherwise releasing from sleeve 344. As sleeve 344 rotates further, the remaining developer mix passes under lid 324 and is carried back to reservoir 302 by magnetic roll 306. Core 342 includes a release pole 355 positioned near the top of core 342 along the direction of rotation of sleeve 344. Release pole 355 magnetically attracts the remaining developer mix to sleeve 344 as the developer mix is carried the remaining distance to the point where it is released back into reservoir 302. As the remaining developer mix passes the 2 o'clock position of core 342 as viewed in FIG. 5, the developer mix is no longer magnetically retained against sleeve 344 by core 342 allowing the developer mix to fall via gravity and centrifugal force back into reservoir 302.

Figure 6:
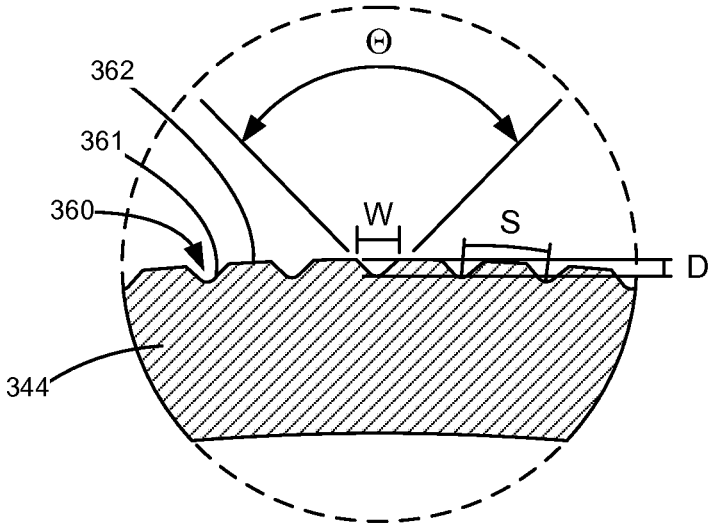
FIG. 6 is a cross-section view of a sleeve of the magnetic roll according to one example embodiment.

With reference to FIG. 6, the outer surface of sleeve 344 includes a series of radially depressed grooves 360. Grooves 360 extend axially along the outer surface of sleeve 344 and are substantially equally spaced from each other circumferentially about the outer surface of sleeve 344. Grooves 360 promote the formation of chains of developer mix on the outer surface of sleeve 344 with the bases of the chains tending to form in grooves 360. The developer mix tends to accumulate and form a shear zone in reservoir 302 upstream from trim bar gap 314. Grooves 360 provide friction between the outer surface of sleeve 344 and the developer mix to move the developer mix through the shear zone in reservoir 302 and trim bar gap 314 to PC drum 310 and to move the developer mix that is not transferred to PC drum 310 past transport pole 354 and release pole 355 to the point where the developer mix is released back into reservoir 302. In one embodiment, sleeve 344 and the grooves 360 therein are formed by extrusion. In another embodiment, grooves 360 are mechanically or laser cut into the outer surface of sleeve 344. In another embodiment, sleeve 344 and the grooves 360 therein are formed by hydroforming.

Sleeve 344 includes a groove density of at least 1.91 grooves/mm of the circumference of the outer surface of sleeve 344 with a circumferential spacing S between grooves 360 of 0.52 min or less. For example, in one embodiment, sleeve 344 has an outer diameter of 25 mm and at least 150 grooves. In another embodiment, sleeve 344 includes an outer diameter of 20 mm and at least 120 grooves. In some embodiments, sleeve 344 includes a groove density of between 1.91 grooves/mm of the circumference of the outer surface of sleeve 344 and 3.18 grooves/mm of the circumference of the outer surface of sleeve 344 with a circumferential spacing S between grooves 360 of between 0.31 mm and 0.52 min. Embodiments include those where the groove density of sleeve 344 is about 2.55 grooves/mm of the circumference of the outer surface of sleeve 344 (e.g., a sleeve 344 having an outer diameter of 25 mm and 200 grooves or a sleeve 344 having an outer diameter of 20 mm and 160 grooves) with a circumferential spacing S between grooves 360 of about 0.39 mm. In some embodiments, sleeve 344 includes between 150 and 250 circumferentially spaced grooves 360 and a diameter between 24 mm and 26 mm.

Accordingly, sleeve 344 has a higher groove density than the prior art grooved magnetic roll sleeves having a groove density of 1.27 grooves/mm discussed above. As a result, the outer surface of sleeve 344 also has surface area between grooves 360 that is less than the prior art grooved magnetic roll sleeves having a groove density of 1.27 grooves/mm discussed above. It has been observed that, during operation, toner tends to accumulate on the outer surface 362 of sleeve 344 between grooves 360 over the life of magnetic roll 306. The accumulation of toner on the outer surface 362 of sleeve 344 between grooves 360 increases the friction between the outer surface of sleeve 344 and the developer mix which, in turn, increases the mass of developer mix on the outer surface of sleeve 344 downstream from trim bar gap 314. Reducing the surface area between grooves 360 of sleeve 344 reduces the fraction of the outer surface of sleeve 344 that is susceptible to increased friction between the outer surface of sleeve 344 and the developer mix due to the accumulation of toner thereby providing a more stable and consistent mass of developer mix on the outer surface of sleeve 344 downstream from trim bar gap 314 over the life of magnetic roll 306. Further, it has been observed that the reduced surface area between grooves 360 of sleeve 344 causes more of the chains of developer mix to form in grooves 360 and less to form on the outer surface 362 of sleeve 344 between grooves 360.

The width W of each groove 360 (in the circumferential direction of sleeve 344) is typically at least several carrier bead diameters to allow multiple carrier beads to fit within groove 360 in order to minimize slipping of the developer mix on the outer surface of sleeve 344. In one embodiment, each carrier bead is spherical and has a diameter of between 0.030 mm and 0.035 mm. If the width W of grooves 360 is not large enough, the carrier bead chains will not be able to form a strong enough base in grooves 360 to resist slipping as the bead chains pass through trim bar gap 314. The slope of the walls 361 of each groove 360 also impacts the amount of carrier beads that can attach inside of each groove 360. If the slope of walls 361 is too shallow relative to the outer surface of sleeve 344, grooves 360 are more susceptible to toner buildup over the life of magnetic roll 306 thereby changing the amount of friction with the developer mix in the grooves 360 over the life of magnetic roll 306. Conversely, if walls 361 are too perpendicular to the outer surface of sleeve 344, sleeve 344 becomes more expensive and difficult to manufacture. In some embodiments, the width W of grooves 360 is between 0.14 mm and 0.23 mm and the angle Φ between walls 361 is between 55 degrees and 95 degrees. In one embodiment, the width W of grooves 360 is between 0.19 mm and 0.23 mm and the angle Φ between walls 361 is between 85 degrees and 95 degrees.

The depth D of each groove 360 (in the radial direction of sleeve 344) also impacts how much of the carrier bead chain can form inside of each groove 360. If the depth D of the groove 360 is too shallow, then there isn't enough room for the carrier bead chain to form an adequate base. As a result, the grooves 360 don't create enough friction with the developer mix to transport the developer mix through trim bar gap 314. Conversely, if the depth D of each groove 360 is too deep, sleeve 344 becomes more expensive and difficult to manufacture. The depth D of each groove 360 is typically at least one carrier bead diameter. In one embodiment, the depth D of grooves 360 is between 0.07 mm and 0.09 mm.

In order to achieve consistent mass of the developer mix on the outer surface of sleeve 344 downstream from trim bar gap 314 over the life of magnetic roll 306 and, therefore, consistent print quality, the total indicated runout of sleeve 344 is 0.05 mm or less. In some embodiments, the total indicated runout of sleeve 344 is 0.03 mm or less. If the total indicated runout is too high, the size of trim bar gap 314 will vary along the axial length of magnetic roll 306 such that the mass of the developer mix on the outer surface of sleeve 344 downstream from trim bar gap 314 will vary along the axial length of magnetic roll 306 resulting in inconsistent print darkness along the width of a printed page.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An outer sleeve of a magnetic roll for a dual component development electrophotographic image forming device, comprising:

a series of grooves in an outer surface of the outer sleeve, the grooves extend along an axial length of the outer sleeve and are spaced circumferentially from each other around the outer sleeve, wherein the outer sleeve has an outer diameter of between 15 mm and 30 mm, inclusive, and the grooves are present on the outer surface of the outer sleeve at a groove density of at least 2.55 grooves/mm of the circumference of the outer surface of the outer sleeve.

2. The outer sleeve of claim 1, wherein the grooves are present on the outer surface of the outer sleeve at a groove density of between 2.55 grooves/mm of the circumference of the outer surface of the outer sleeve and 3.18 grooves/mm of the circumference of the outer surface of the outer sleeve, inclusive.

3. The outer sleeve of claim 1, wherein the grooves are present on the outer surface of the outer sleeve at a groove density of 2.55 grooves/mm of the circumference of the outer surface of the outer sleeve.

4. The outer sleeve of claim 3, wherein the outer sleeve has an outer diameter of 25 mm.

5. The outer sleeve of claim 1, wherein a total indicated runout of the outer sleeve is 0.03 mm or less.

6. The outer sleeve of claim 1, wherein a width of the grooves in a circumferential direction of the outer sleeve is between 0.19 mm and 0.23 mm, inclusive.

7. The outer sleeve of claim 1, wherein the grooves are open at the outer surface of the outer sleeve at an angle of between 85 degrees and 95 degrees, inclusive.

8. The outer sleeve of claim 1, wherein a depth of the grooves in a radial direction of the outer sleeve is between 0.07 mm and 0.09 mm, inclusive.

9. The outer sleeve of claim 1, wherein a total indicated runout of the outer sleeve is 0.05 mm or less.

10. An outer sleeve of a magnetic roll for a dual component development electrophotographic image forming device, comprising:

between 200 and 250 grooves, inclusive, in an outer surface of the outer sleeve, the grooves extend along an axial length of the outer sleeve and are spaced circumferentially from each other around the outer sleeve, wherein the outer sleeve has an outer diameter of between 24 mm and 26 mm, inclusive.

11. The outer sleeve of claim 10, wherein 200 grooves are present in the outer surface of the outer sleeve.

12. The outer sleeve of claim 11, wherein the outer sleeve has an outer diameter of 25 mm.

13. The outer sleeve of claim 10, wherein a total indicated runout of the outer sleeve is 0.05 mm or less.

14. The outer sleeve of claim 9, wherein a width of the grooves in a circumferential direction of the outer sleeve is between 0.19 mm and 0.23 mm, inclusive.

15. The outer sleeve of claim 10, wherein the grooves are open at the outer surface of the outer sleeve at an angle of between 85 degrees and 95 degrees, inclusive.

16. The outer sleeve of claim 9, wherein a depth of the grooves in a radial direction of the outer sleeve is between 0.07 mm and 0.09 mm, inclusive.

17. A magnetic roll for a dual component development electrophotographic image forming device, comprising:

a stationary core having at least one permanent magnet;

a sleeve positioned around the core that is rotatable relative to the core about an axis of rotation; and a series of grooves in an outer surface of the sleeve, the grooves extend along the axial length of the sleeve and are spaced circumferentially from each other around the sleeve, wherein the sleeve has an outer diameter of between 15 mm and 30 mm, inclusive, and the grooves are present on the outer surface of the sleeve at a groove density of at least 2.55 grooves/mm of the circumference of the outer surface of the sleeve.

18. The magnetic roll of claim 17, wherein the grooves are present on the outer surface of the sleeve at a groove density of between 2.55 grooves/mm of the circumference of the outer surface of the sleeve and 3.18 grooves/mm of the circumference of the outer surface of the sleeve, inclusive.

19. The magnetic roll of claim 17, wherein the grooves are present on the outer surface of the sleeve at a groove density of 2.55 grooves/mm of the circumference of the outer surface of the sleeve.

20. The magnetic roll of claim 19, wherein the sleeve has an outer diameter of 25 mm.

21. The magnetic roll of claim 17, wherein a total indicated runout of the sleeve is 0.03 mm or less.

22. The magnetic roll of claim 17, wherein a width of the grooves in a circumferential direction of the sleeve is between 0.19 mm and 0.23 mm, inclusive.

23. The magnetic roll of claim 17, wherein the grooves are open at the outer surface of the sleeve at an angle of between 85 degrees and 95 degrees, inclusive.

24. The magnetic roll of claim 17, wherein a depth of the grooves in a radial direction of the sleeve is between 0.07 mm and 0.09 mm, inclusive.

25. The magnetic roll of claim 17, wherein a total indicated runout of the sleeve is 0.05 mm or less.

* * * * *